US008871704B2

(12) United States Patent
Wakhloo et al.

(10) Patent No.: US 8,871,704 B2
(45) Date of Patent: Oct. 28, 2014

(54) CLEANING COMPOSITION

(71) Applicant: OTI Greentech Group AG, Zug (CH)

(72) Inventors: Jawahar Wakhloo, Saarbrucken (DE); Alan Keasey, North Ferriby (GB); Caroline Kelly, Romanby (GB)

(73) Assignee: OTI Greentech Group AG, Zug (CH)

( * ) Notice: Subject to any disclaimer, the term of this patent is extended or adjusted under 35 U.S.C. 154(b) by 0 days.

(21) Appl. No.: 13/871,941

(22) Filed: Apr. 26, 2013

(65) Prior Publication Data

US 2014/0155311 A1 Jun. 5, 2014

(30) Foreign Application Priority Data

Nov. 30, 2012 (GB) ..... 1221630.5

(51) Int. Cl.

| | |
|---|---|
| ***C11D 1/22*** | (2006.01) |
| ***C11D 1/72*** | (2006.01) |
| ***C11D 1/722*** | (2006.01) |
| ***C11D 11/00*** | (2006.01) |
| ***C11D 1/83*** | (2006.01) |
| *C11D 1/14* | (2006.01) |

(52) U.S. Cl.

CPC ..... *C11D 1/8305* (2013.01); *C11D 1/72* (2013.01); *C11D 11/0029* (2013.01); *C11D 1/22* (2013.01); *C11D 1/146* (2013.01); *C11D 1/143* (2013.01); *C11D 1/722* (2013.01)

USPC ..... 510/535; 510/245; 510/421; 510/424; 510/426; 510/475; 510/492; 510/505

(58) Field of Classification Search

USPC ..... 510/245, 421, 424, 426, 475, 492, 505, 510/535

See application file for complete search history.

(56) References Cited

U.S. PATENT DOCUMENTS

| | | | | |
|---|---|---|---|---|
| 4,311,608 | A | 1/1982 | Maurice | |
| 2008/0023044 | A1 * | 1/2008 | Hubrig et al. | 134/26 |
| 2008/0188396 | A1 * | 8/2008 | Holland et al. | 510/421 |
| 2008/0293612 | A1 | 11/2008 | Kellar et al. | |
| 2011/0094044 | A1 * | 4/2011 | Shamayeli et al. | 8/137 |

FOREIGN PATENT DOCUMENTS

| | | | |
|---|---|---|---|
| FR | 2645876 | A1 | 10/1990 |
| GB | 2259518 | A | 3/1993 |
| JP | 11172282 | A | 6/1999 |

* cited by examiner

*Primary Examiner* — Brian P Mruk

(74) *Attorney, Agent, or Firm* — Janet Sleath; Speckman Law Group PLLC

(57) ABSTRACT

An industrial cleaning composition is provided that includes: (a) from 5 to 50% by volume of an anionic surfactant having a $\log_{10}P$ value in the range 5 to 7; (b) from 5 to 50% by volume of a first non-ionic surfactant having a $\log_{10}P$ value in the range 0.1 to 3 and having the general formula, R'—$(A0)_n$—OH, wherein R' is $C_9$ to $C_{20}$ alkyl, each AO unit is either —$OCH_2CH_2$— or —$OCH_2CH(CH_3)$—, the molar ratio [—$OCH_2CH(CH_3)$—]/[—$OCH_2CH_2$—] is in the range up to 8 and n is greater than 6; and (c) from 5 to 50% by volume of a second non-ionic surfactant having a $\log_{10}P$ value in the range 0.1 to 3 having the general formula, R'—$(OCH_2CH_2)_n$—OH wherein R' is $C_9$ to $C_{20}$ alkyl, and n is less than 6, each of said volume percentages being with respect to the total volume of (a), (b) and (c). Corresponding cleaners derived therefrom by water dilution are also disclosed.

17 Claims, No Drawings

CLEANING COMPOSITION

REFERENCE TO RELATED APPLICATION

This application claims priority to UK patent application no. 1221630.5, filed Nov. 30, 2012.

TECHNICAL FIELD

The present invention relates to a method for cleaning surfaces coated with zinc silicate or the like and to compositions suitable for cleaning such surfaces.

BACKGROUND

Zinc silicate primers are extensively used throughout industry to coat ferrous metal structures and combat corrosion thereof by acting as a sacrificial anode. Examples of such primers typically include compositions formulated with a builder such as a polysiloxane or epoxy resin. When applied to the surface of for example steel to a typical thickness of 60 to 70 microns and allowed to cure they produce a ceramic coating which is hard, abrasion resistant and, in the absence of acid or base, does not otherwise chemically degrade. This makes them especially useful for coating the internal surfaces of tanks especially those used in marine applications where the possibility of physical damage and exposure to corrosive salt spray exists.

One drawback of such primed surfaces is that they are less smooth than the corresponding bare metal. This makes them somewhat difficult to clean which in turn can lead to problems, for example, on-board a ship where it is desired to change the transportation duty of a given cargo tank, for example from a heavy hydrocarbon to an alcohol such as methanol, because the cleaning cycle can be lengthy and require the entry of humans into a hazardous environment to ensure cleaning is complete.

SUMMARY

We have now developed cleaning compositions which, relative to those currently in use today, represent an improvement in both the extent to and the speed with which cleaning can occur. Furthermore, their improved performance can reduce substantially the need for steam cleaning thereby leading to significant environmental and energy savings. Thus, according to the present invention, there is provided a method of removing contaminants from a surface coated with a zinc silicate primer characterized in that it comprises the step of contacting the surface with a cleaning composition comprising (a) from 5 to 50% by volume of an anionic surfactant having a $\log_{10}P$ value in the range 5 to 7, (b) from 5 to 50% by volume of a first non-ionic surfactant having a $\log_{10}P$ value in the range 0.1 to 3 and having the general formula, R'—$(A0)_n$—OH wherein R' is $C_9$ to $C_{20}$ alkyl, each AO unit is either —$OCH_2CH_2$— or —$OCH_2CH(CH_3)$—; the molar ratio [—$OCH_2CH(CH_3)$—]/[—$OCH_2CH_2$—] is in the range up to 8 and n is greater than 6 and (c) from 5 to 50% by weight or volume of a second non-ionic surfactant having a $\log_{10}P$ value in the range 0.1 to 3 having the general formula, R'—$(OCH_2CH_2)_n$—OH wherein R' is $C_9$ to $C_{20}$ alkyl, and n is less than 6 each of said volume percentages being with respect to the total volume of (a), (b) and (c).

In certain circumstances, the various surfactants described above may be sourced in water diluted as opposed to pure form. For example, commercially available anionic surfactants typically comprise a 30-40% solution of the active component in water. Since the various volume ranges defined herein are with respect to 100% actives, any dilution effect will need to be taken into account when making up the cleaning composition or cleaner derived therefrom.

Whilst the cleaning composition described above can be used in undiluted form for spot cleaning duties, it is preferably employed, for reasons of economy, in the form of a corresponding water diluted cleaner in which the cleaning composition comprises less than 5%, more preferably less than 1%, most preferably less than 0.75% by volume of the whole. It will appreciated that, whilst such cleaners will typically be prepared directly by diluting the cleaning composition itself, indirect manufacture for example by adding the required small amounts of the various surfactants directly into water is also a possibility. Preferably the pH of the cleaner is in the range from 6 to 9 most preferably from 7 to 8.

In addition to the three components of the cleaning composition described above, it is envisaged that other useful additives, for example dyes, anti-foams and the like, can be present too.

As used herein, the term $\log_{10}P$ means the logarithm of the partition coefficient P for a given component of the cleaning composition measured with respect to a standard two-phase n-octanol/water system. Further information about this methodology may be found in for example Ecotoxicology and Environmental Safety, 11(3) 1986, pp.251-260.

Turning to the anionic surfactant, in one embodiment it is one or a mixture of compounds selected from $C_{12}$ to $C_{18}$ alkyl sulphonic or sulphuric acids or a corresponding salt thereof, preferably a Group IA or Group IIA metal or a quaternary ammonium salt, or from linear alkyl benzene sulfonic acids or a salt thereof, preferably a Group IA or Group IIA metal salt or quaternary ammonium salt. In another embodiment, it is selected from $C_{12}$ to $C_{18}$ alkyl polyether sulphonic or sulphuric acids or a corresponding salt thereof, preferably a Group IA or Group IIA metal or quaternary ammonium salt, or linear alkyl benzene polyether sulfonic acids or a salt thereof, preferably a Group IA or Group IIA metal salt or quaternary ammonium salt. Examples of preferable anionic surfactants include sodium lauryl sulphonate or sulphate, magnesium lauryl sulphonate or sulphate, tetraethylammonium lauryl sulphonate or sulphate, mixed $C_{14}$ to $C_{16}$ alkyl sulphate or sulphonate salts of sodium, potassium or magnesium and mixed $C_{12}$ to $C_{14}$ alkyl sulphate or sulphonate salts of sodium, potassium or magnesium. Preferable linear alkyl benzene sulphonic acids or salts thereof include $C_6$ to $C_{12}$ alkyl benzene sulphonic acids or salts thereof. In the case of polyether sulphonates, which are characterised by a polyether unit between the aliphatic or aromatic component and the sulphonate or sulphonate group, this is suitably a polyether comprised of up to 20 —$OCH_2CH_2$— units. The alkyl groups in the above may be branched or unbranched.

Preferably the cleaning composition comprises from 5 to 20% by volume of the anionic surfactant.

The first non-ionic surfactant, which is employed in the cleaning composition and which is relatively hydrophilic, is suitably one or mixture of compounds having the general formula, R'—$(A0)_n$—OH wherein R' is $C_9$ to $C_{20}$ alkyl, preferably $C_9$ to $C_{16}$ alkyl, each AO unit is either —$OCH_2CH_2$— or —$OCH_2CH(CH_3)$—; the molar ratio [—$OCH_2CH(CH_3)$—]/[—$OCH_2CH_2$—] is in the range up to 8, preferably from 4 to 8, and n is greater than 6, preferably from 7 to 15. Such surfactants are typically prepared by alkoxylating the corresponding fatty alcohol R'OH which itself can be derived from naturally-occurring sources or from precursor lower molecular weight alcohols using for example the Guerbet synthesis. Typically such surfactants are referred to as 'linker surfactants' and are characterized by a critical micelle concentration (CMC) which is relatively low. The alkyl groups themselves can be branched or unbranched.

The second non-ionic surfactant, which is employed in the cleaning composition and which is relatively hydrophobic, is suitably one or mixture of compounds having the general formula, R'—$(OCH_2CH_2)_n$—OH wherein R' is $C_9$to $C_{20}$ alkyl, preferably $C_9$to $C_{16}$ alkyl, and n is less than 6, preferably from 2 to 5. Such surfactants are also typically prepared by alkoxylating the corresponding fatty alcohol R'OH which itself can be derived from naturally-occurring sources or from precursor lower molecular weight alcohols using by the Guerbet synthesis. The alkyl groups can also be branched or unbranched.

Preferably either or both of the two non-ionic surfactants comprise from 10 to 45% by volume of the cleaning composition.

The method of the present invention is generally applicable to the cleaning of all hard surfaces which comprise a coating of zinc silicate but is especially useful for cleaning the dirty surfaces of coated stainless or mild steel storage tanks. It can be used to particular advantage to clean the cargo tanks or holds of ships. Any method using the cleaner, i.e. the diluted cleaning composition, can be employed to effect cleaning although typically the cleaner will be brought into contact with the dirty surface using an industrial sprayer assembly which is adapted to collect and recirculate the liquid. If so desired, the surfaces can at the same time be brushed or scrubbed. Thereafter, once a suitable period of cleaning time has elapsed, the cleaned surfaces can be rinsed with clean water and/or a sample of the next cargo to be used. Suitably the diluted cleaning composition is sprayed onto the dirty surfaces at a temperature of less than 100° C., typically from 60 to 80° C. The cleaning composition is especially suitable for removing contaminants comprising high molecular weight hydrocarbons such as diesel, gas-oil, kerosene, vegetable oils and the like from tanks.

The method of the present invention will now be illustrated with reference to the following tests which demonstrate the superiority of the cleaning compositions of the present invention over the prior art.

General Methodology

Test panels made of stainless steel or mild steel coated with an industry standard zinc silicate coating were immersed in ultra-low sulphur diesel for a period of three days to simulate the contamination occurring in a cargo tank. After removal and being allowed to drain, the panels were tested in a rig designed to remove as much of the residual diesel adhering to the panel as possible under a standard set of cleaning conditions. In this rig the cleaner was applied to the test panel by means of a sprayer adapted for continuous liquid recycle thereby enabling the contaminated panel surfaces to be continuously contacted with the cleaner for a period of 2 hours. During this time the temperature of the cleaner was maintained at 70° C. At the end of the test period, spraying was stopped, the panels washed with clean water and the residual diesel on the panels determined by immersing the panels in a standard volume of methanol at room temperature for 5 minutes and then measuring the amount of diesel extracted using UV/visible spectroscopy. By calibration with standard samples of known concentrations, the amount of diesel in the methanol was quantified as an average residual hydrocarbon reading (ARHR) indicative of the effectiveness of the cleaner. Here, the higher the ARHR the less effective is the cleaner.

EXAMPLE 1 (COMPARATIVE)

In this example, a baseline was established using water at 70° C. The ARHR reading was 550.

EXAMPLE 2 (COMPARATIVE)

In this example, the cleaner was a 0.5% by weight aqueous solution of Accell Clean a material which has been rated for use in cleaning marine tanks and which comprises a mixture of a surfactant and proteins having a pH in the range 5.5 to 6.5. The ARHR reading obtained was 50.

EXAMPLE 3

In this example, the cleaner (pH 7-8) was a 0.5% by weight aqueous solution of a cleaning composition according to the present invention comprising (by volume):

- 45.0% Hansanol AS240A® (30% aqueous solution of a sodium salt of a sulphonated mono $C_{12}$ to $C_{14}$ alkyl ester surfactant; ex Hansa Group);
- 27.5% Berol 185® (non-ionic surfactant of formula $C_{10-16}(OCH_2CH_2)_n(OCH_2CH(CH_3))_mOH$ where n is 5-10 and m is 1-3; ex AkzoNobel);
- 27.5% Ethylan 1005® (non-ionic surfactant of formula $C_{10}(OCH_2CH_2)_5OH$; ex AkzoNobel) and
- 0.5% anti-foam JH FDP® (silicone anti-foam; ex Julius Hoesch).

The ARHR reading obtained was 25.

EXAMPLE 4

Example 3 was repeated except that the volume component of the three surfactants was respectively 35%, 30% and 35% and no anti-foam was employed. The ARHR reading obtained was 35.

EXAMPLE 5

Example 4 was repeated except that 35% Serdet DSK-30® (sodium salt of a C12-C14 alcohol sulphate (30% solution); ex Elementis Specialities) was employed instead of the Hansanol AS240A. The ARHR reading was 28.

EXAMPLE 6

In this example, the cleaner (pH 7-8) was a 0.8% by weight aqueous solution of a cleaning composition according to the present invention comprising (by volume):

- 25.0% BioSoft D-40® (sodium, 2-dodecylbenzene sulphonate surfactant; ex Stepan Company);
- 45% Lutensol XP90® (a non-ionic surfactant of formula $C_{10}(OCH_2CH2)_9OH$; wherein the $C_{10}$ alkyl group is branched and derived from a $C_{10}$ Guerbet alcohol; ex BASF);
- 30% Ethylan 1005® (non-ionic surfactant of formula $C_{9-11}(OCH_2CH2)_5OH$; ex AkzoNobel) and 0.5% anti-foam JH FDP® (silicone anti-foam; ex Julius Hoesch). The ARHR reading obtained was 25.

EXAMPLE 7

In this example, the composition comprised 15% Serdet DLK-9/30®, 45% Lutensol XP90® and 30% Ethylan 1005® and was used at a 1% dilution level in water. The ARHR reading was 40.

EXAMPLE 8 (COMPARATIVE)

In this example, a binary composition comprising 30% Hostapur SAS30® (sodium secondary $C_{14-17}$ alkyl sulphonate; ex Hostapur) and 70% Lutensol XP90® was employed. The ARHR reading was 48.

The invention claimed is:

1. An industrial cleaning composition consisting of:

(a) from 5 to 50% by volume of an anionic surfactant having a $\log_{10}P$ value in the range 5 to 7;

(b) from 5 to 50% by volume of a first non-ionic surfactant having a $\log_{10}P$ value in the range 0.1 to 3 and having the general formula, R'—$(A0)_n$—OH, wherein R' is $C_9$ to $C_{20}$ alkyl, each AO unit is either —$OCH_2CH_2$— or —$OCH_2CH(CH_3)$—, the molar ratio [—$OCH_2CH(CH_3)$—]/[—$OCH_2CH_2$—] is in the range up to 8 and n is greater than 6;

(c) from 5 to 50% by volume of a second non-ionic surfactant having a $\log_{10}P$ value in the range 0.1 to 3 and having the general formula, R'—$(OCH_2CH_2)_n$—OH, wherein R' is $C_9$ to $C_{20}$ alkyl, and n is less than 6, and (d) an anti-foam.

2. An industrial cleaning composition as claimed in claim 1, wherein the anionic surfactant is one or a mixture of compounds selected from $C_{12}$ to $C_{18}$ aliphatic sulphonic or sulphuric acids or salts thereof.

3. An industrial cleaning composition as claimed in claim 1, wherein the anionic surfactant is one or a mixture of linear alkyl benzene sulfonic acids or salts thereof.

4. An industrial cleaning composition as claimed in claim 2, wherein the salt is a Group IA or Group IIA metal salt or quaternary ammonium salt.

5. An industrial cleaning composition as claimed in claim 1, wherein the first non-ionic surfactant is one in which n is from 7 to 15.

6. An industrial cleaning composition as claimed in claim 1, wherein the first non-ionic surfactant is one in which R' is unbranched $C_9$ to $C_{16}$ alkyl.

7. A industrial cleaning composition as claimed in claim 1, wherein the second non-ionic surfactant is one in which n is from 2 to 5.

8. An industrial cleaning composition as claimed in claim 1, wherein the second non-ionic surfactant is one in which R' is branched $C_9$ to $C_{16}$ alkyl.

9. An industrial cleaner consisting of:

less than 1% volume solution of:

(a) from 5 to 50% by volume of an anionic surfactant having a $\log_{10}P$ value in the range 5 to 7;

(b) from 5 to 50% by volume of a first non-ionic surfactant having a $\log_{10}P$ value in the range 0.1 to 3 and having the general formula, R'—$(AO)_n$—OH, wherein R' is $C_9$ to $C_{20}$ alkyl, each AO unit is either —$OCH_2CH_2$—or —$OCH_2CH(CH_3)$—, the molar ratio [—$OCH_2CH(CH_3)$—]/[—$OCH_2CH_2$—] is in the range up to 8 and n is greater than 6;

(c) from 5 to 50% by volume of a second non-ionic surfactant having a $\log_{10}P$ value in the range 0.1 to 3 and having the general formula, R'—$(OCH_2CH_2)_n$—OH, wherein R' is $C_9$ to $C_{20}$ alkyl, and n is less than 6; and (d) an anti-foam;

in water.

10. An industrial cleaning composition as claimed in claim 3, wherein the salt is a Group IA or Group IIA metal salt or quaternary ammonium salt.

11. An industrial cleaning composition as claimed in claim 1, wherein the composition has a pH of from 6 to 9.

12. An industrial cleaning composition of claim 1, wherein the composition is effective in cleaning hard surfaces coated with a corrosion-resistant primer.

13. An industrial cleaning composition of claim 12, wherein the corrosion-resistant primer acts as a sacrificial anode.

14. An industrial cleaning composition of claim 12, wherein the corrosion-resistant primer is a zinc silicate primer.

15. An industrial cleaner of claim 9, wherein the composition is effective in cleaning hard surfaces coated with a corrosion-resistant primer.

16. An industrial cleaner of claim 15, wherein the corrosion-resistant primer acts as a sacrificial anode.

17. An industrial cleaner of claim 15, wherein the corrosion-resistant primer is a zinc silicate primer.

* * * * *